United States Patent [19]

Shimosato et al.

[11] Patent Number: 4,976,554

[45] Date of Patent: Dec. 11, 1990

[54] RELEASE-TYPE DOT PRINT HEAD AND METHOD OF MANUFACTURING THE SAME

[75] Inventors: Masashi Shimosato; Kuniaki Ochiai; Shinzi Tsuyuki, all of Shizuoka, Japan

[73] Assignee: Tokyo Electric Company, Ltd., Tokyo, Japan

[21] Appl. No.: 257,876

[22] Filed: Oct. 14, 1988

[30] Foreign Application Priority Data

| | | | |
|---|---|---|---|
| Oct. 15, 1987 | [JP] | Japan | 62-260700 |
| Feb. 12, 1988 | [JP] | Japan | 63-17955 |
| Jul. 22, 1988 | [JP] | Japan | 63-183120 |

[51] Int. Cl.[5] ..... B41J 2/275; B41J 2/24

[52] U.S. Cl. ..... 400/124; 29/602.1

[58] Field of Search ..... 29/602.1, 606; 101/93.04, 93.05; 400/121, 124, 157.2, 719

[56] References Cited

U.S. PATENT DOCUMENTS

| | | | |
|---|---|---|---|
| 2,129,065 | 9/1938 | Loop | 400/124 |
| 4,167,343 | 9/1979 | Golobay | 400/124 |
| 4,278,020 | 7/1981 | Oaten | 400/124 |
| 4,437,775 | 3/1984 | Ochiai et al. | 400/124 |
| 4,472,071 | 9/1984 | Blomquist et al. | 400/124 |
| 4,537,520 | 8/1985 | Ochiai et al. | 400/124 |
| 4,571,101 | 2/1986 | Sakaida | 400/719 X |
| 4,611,393 | 9/1986 | Norigoe | 29/602.1 |
| 4,618,277 | 10/1986 | Asano | 400/124 |
| 4,634,301 | 1/1987 | Sakaida | 400/124 |
| 4,652,158 | 3/1987 | Asano | 400/124 |
| 4,674,179 | 6/1987 | Gugel | 29/602.1 |
| 4,767,226 | 8/1988 | Sakaida et al. | 400/124 |

FOREIGN PATENT DOCUMENTS

| | | | |
|---|---|---|---|
| 0041126 | 9/1981 | European Pat. Off. | 400/124 |
| 35736 | 3/1977 | Japan | 228/215 |
| 120257 | 9/1979 | Japan | 228/215 |
| 0201669 | 12/1982 | Japan | 400/124 |
| 0008665 | 1/1983 | Japan | 400/124 |
| 0104761 | 6/1983 | Japan | 400/124 |
| 60-47567 | 12/1985 | Japan | 400/124 |
| 44656 | 3/1986 | Japan | 400/124 |
| 0121958 | 6/1986 | Japan | 400/124 |
| 570464 | 8/1977 | U.S.S.R. | 228/215 |
| 1478498 | 6/1977 | United Kingdom | 228/215 |

*Primary Examiner*—David A. Wiecking

*Attorney, Agent, or Firm*—Oblon, Spivak, McClelland, Maier & Neustadt

[57] ABSTRACT

A release-type dot print head formed by joining together a magnet unit, and an armature unit formed by brazing torsion bars to armatures and supporting parts formed integrally with a second yoke with the armatures in a state in which the free ends of styluses fixed to the free ends of the armatures project from the outer surface of a stylus guide attached to the second yoke by a predetermined length. Portions of the free ends of the styluses projecting from the outer surface of the stylus guide are cut off by a wire-cut electrical discharge cutting process with the styluses in a free state to adjust the length of projection of the free ends of the stylus to a predetermined length. The second yoke and the stylus guide are formed respectively of materials having substantially the same coefficients of thermal expansion. The armature unit is subjected to heat treatment after assembly.

4 Claims, 6 Drawing Sheets

RELEASE-TYPE DOT PRINT HEAD AND METHOD OF MANUFACTURING THE SAME

FIELD OF THE INVENTION AND RELATED ART STATEMENT

The present invention relates to a dot print head for an impact dot printer employing styluses and, more particularly, to a dot print head for a release-type dot print head for a dot printer, having armatures each fixedly holding a stylus, resiliently attracted to a core mounted with a solenoid by the magnetism of a permanent magnet, and capable of being turned so that the stylus is advanced for printing when the magnetism of the permanent magnet acting thereon is cancelled by energizing the solenoid, and to a method of such a release-type dot print head.

Referring to FIGS. 12, 13 and 14 showing a conventional dot print head, a plurality of cores 6 are fixed to a yoke 50, and a plurality of solenoids 7 are mounted respectively on the cores 6. A permanent magnet 52 is held on the upper open end, as viewed in FIG. 12, of the yoke 50 with a holding member 51. A plurality of armature assemblies 56 are screwed to a yoke 57 for forming a side magnetic path. Each armature assembly 56 comprises an armature 54 having an arm 53 fixedly holding a stylus 10 at the extremity thereof, a holder 55, and a torsion bar 15 connecting the armature 54 to the holder 55. A nose 12 provided with a stylus guide 11 having guide holes for guiding the free ends of the styluses 10 is fixed to the yoke 57.

The armatures 54 are attracted to the end surfaces of the corresponding core 6 by the magnetism of the permanent magnet 52, so that the torsion bars 15 are twisted elastically. When the solenoid 7 is energized to cancel the magnetism of the permanent magnet 52, the armature 54 is released from the core 6 by resilient energy stored in the torsion bar 15 to project the stylus 10 from the stylus guide 11 for printing.

To ensure such a printing operation, the armature assembly 56 must be assembled correctly. In assembling the armature assembly 56, the holder 55 and the armature 54 are positioned correctly relative to each other, and then the torsion bar 15 is brazed to the holder 55 and armature 54. In connecting the armature 54 to the holder 55 by brazing, the position of the armature 54 relative to the holder 55 will change unless the torsion bar 15 is supported in a free state. That is, in FIG. 13, the armature 54 attracted to the end surface of the core 6, namely, the armature 54 positioned at a standby position, by twisting the torsion bar 15 is indicated by imaginary lines, and the armature 54 released from the core 6, namely, the armature 54 positioned at an operative position, by resilient energy stored in the torsion bar 15 is indicated by solid lines. When the armature 54 is released from the core 6 and positioned at the operative position, the lower surface 54*a*, as viewed in FIG. 13, thereof facing the upper end, as viewed in FIG. 12, of the core 6 is inclined at an angle $\theta$ to the upper surface of the core 6. The torsion bar 15 is brazed to the armature 54 and the holder 55 with the armature 54 located at the operative position relative to the holder 55 as indicated by solid lines in FIG. 13. In brazing the torsion bar 15 to the armature 54 and the holder 55, the armature 54 and the holder 55 must be held firmly with the surface 54*a* of the armature 54 inclined at the angle $\theta$ to a plane including the surface 55*a* on the side of the core, namely, the lower surface as viewed in FIG. 13, of the holder 55. In this state, the back surface 54*b*, namely, the upper surface as viewed in FIG. 13, of the armature 54 is in parallel to or included in a plane including the contact surface 55*b*, namely, the upper surface as viewed in FIG. 13, of the holder 55. The armature 54 and the holder 55 are held firmly on a jig with the back surface 54*b* of the armature 54 and the contact surface 55*b* of the holder 55 placed respectively on reference surfaces of the jig, and then the torsion bar 15 is welded or brazed at the middle portion thereof to the armature 54 and at the opposite ends thereof to the holding arms of the holder 55.

The angle $\theta$ is dependent on the size and shape of the armature 54. Furthermore, since the distances between the back surface 54, which is a reference surface to be inclined at the angle $\theta$ to a plane including the surface 55*a* of the holder 55, and the torsion bar 15 and between the contact surface 55*b* of the holder 55 and the torsion bar 15 are small, error in the inclination of the armature 54 is enlarged at the tip of the stylus 10 remote from the torsion bar 15. Still further, in attaching the armature assemblies 56 thus assembled individually to the yoke 57 with screws, it is possible that the armature assemblies 56 are arranged irregularly. After individually fixing the plurality of armature assemblies 56 to the yoke 57, the armatures 54 are pushed out toward the cores 6 to a position indicated by imaginary lines in FIG. 13, and then the surfaces 55*a* of the holders 55 on the side of the cores 6 and the surfaces 54*a* of the armature 54 facing the cores 6 are polished. However, when the armatures 54 are returned to their free positions, namely, to the operative positions at which the armatures 54 are positioned when the magnetism of the permanent magnet 52 is cancelled, the respective inclination of the armatures 54 to the end surfaces of the corresponding cores 6 are different from each other, and hence it is impossible to align the respective tips of the styluses 10. Accordingly, the distances of the tips of the styluses 10 from the platen and driving voltages respectively for driving the solenoids 7 must be adjusted to those for the stylus 10 in bad condition, which deteriorates print quality and the performance of the dot print head.

On the other hand, high-speed printing performance and miniaturization are requisite conditions to be met by the release-type dot printer. High restorative force, namely, high torsional torque, of the torsion bar 15 is essential to high-speed printing. According to Hooke's law, $$T = G\theta JL$$

$$J = \pi d^4/32$$

$$\tau = Tr/J$$

where G is the shearing modulus of the material, $\theta$ is the angle of torsion of the torsion bar 15 (the angle $\theta$ in FIG. 8), d is the diameter of the torsion bar 15, r is the radius of the torsion bar 15, L is the length of the torsion bar 15, T is the torsional torque, J is the polar moment of inertia of area, and $\tau$ is the maximum shearing stress.

To miniaturize the dot print head, use of a torsion bar having a large torsional torque T for a small angle $\theta$ of torsion is necessary. Such a torsional bar 15 is formed, for example, of a maraging steel.

The torsion bar 15 formed of a steel is subject to thermal degradation in brazing the torsion bar 15 to the armature 56 and the holder 55. Accordingly, the armature assembly 56 (FIG. 14) is subjected to a heat treatment after being assembled by brazing the torsion bar 15 to the armature 54 and the holder 55. The armature assemblies 56 are screwed individually to the yoke 57 after heat treatment. Such a manner of forming the dot print head requires many steps and is liable to cause irregular arrangement of the armature assemblies 56.

OBJECT AND SUMMARY OF THE INVENTION

It is a first object of the present invention to provide a dot print head having accurately arranged armatures.

It is a second object of the present invention to provide a dot print head having styluses arranged with their points in alignment for the same stroke.

It is a third object of the present invention to achieve the heat treatment of torsion bars through a simple process.

It is a fourth object of the present invention to prevent the variation in size of an armature unit attributable to heat treatment.

It is a fifth object of the present invention to assemble a dot print head through a simple assembling process.

In accordance with one aspect of the present invention, a magnet unit is formed by assembling a first yoke having an open end, a plurality of cores mounted respectively with solenoids, and a permanent magnet; a plurality of armatures each fixedly holding a stylus at the extremity thereof are arranged respectively opposite the end surfaces of the cores; a second yoke provided with a stylus guide for guiding the styluses is placed on the open end of the first yoke; supporting parts for supporting the armatures are formed integrally with the second yoke; open grooves opening toward the cores, for receiving torsion bars are formed at least in either the armatures or the supporting parts; torsion bar receiving parts, including grooves similar to the foregoing grooves, for receiving the torsion bars are formed in either the supporting parts or the armatures; an armature unit is formed by placing the armatures with the styluses projecting from the outer surface of the stylus guide by a predetermined length and brazing the torsion bars to the armatures and the supporting parts formed in the second yoke; polished surfaces included in a plane are formed in the open end of the first yoke and the free ends of the cores; polished surfaces included in the same plane as that including the polished surfaces of the open end of the first yoke and the free end of the cores are formed in the inner end surface of the second yoke facing the open end of the first yoke and in the surfaces facing the cores of the armatures located with the tips of the styluses in alignment with the outer surface of the stylus guide; and the polished surfaces of the armature unit are joined to the corresponding polished surfaces of the magnet unit to assemble the armature unit and the magnet unit.

Accordingly, the torsion bars can easily be fitted in the grooves opening toward the cores and are joined to the supporting parts of the second yoke and the armatures, forming the supporting parts integrally with the second yoke reduces the number of the component parts and reduces the positional difference between the armatures. Furthermore, since the open end of the first yoke and the end surfaces of the cores are polished so as to be flush and since the armatures are positioned with respect to the position of the tips of the styluses, which affects print quality directly, in brazing the torsion bars to the armatures and the supporting parts and in polishing the inner surface of the second yoke and the surfaces of the armatures on the side of the cores, the position of the armatures relative to the corresponding cores, the position of the tips of the styluses and the stroke of the styluses are determined without variation between the armatures.

In accordance with another aspect of the present invention, a magnet unit is formed by magnetically connecting a first yoke, a plurality of cores respectively mounted with solenoids, and a permanent magnet; a plurality of armatures fixedly holding styluses at the respective extremities thereof are arranged respectively opposite the end surfaces of the cores; a second yoke provided with a guiding member for slidably guiding the styluses, formed of a material having a coefficient of thermal expansion the same as that of a material forming the second yoke is joined to the end surface of the first yoke; supporting parts for supporting the armatures therebetween are formed integrally with the second yoke; an armature unit is formed by brazing torsion bars for biasing the armatures away from the cores to the armatures and the supporting parts; and the armature unit and the magnet unit are connected together to form a release-type dot print head.

Accordingly, since the armature unit comprising the plurality of armatures is subjected to heat treatment after brazing the torsion bars to the second yoke and the armatures, the assembling process is simplified. Furthermore, since the component parts of the armature unit are formed of materials having substantially the same coefficients of thermal expansion, variation in size of the armature unit attributable to heat treatment can be prevented.

DETAILED DESCRIPTION OF THE PREFERRED EMBODIMENTS

First Embodiment (FIGS. 1 to 6)

Figure 1:
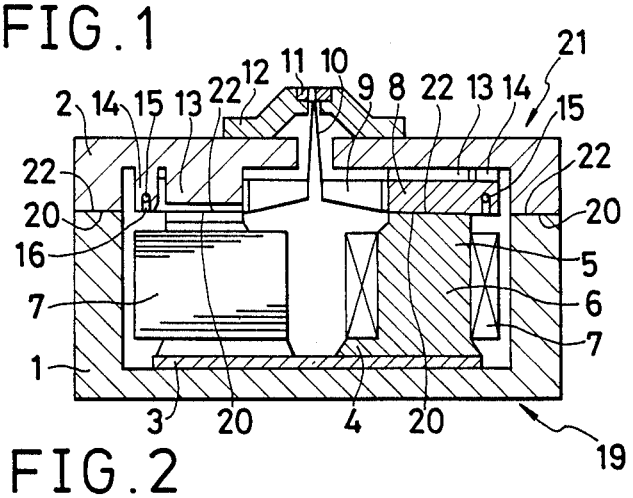
FIG. 1 is a longitudinal sectional side elevation of a dot print head in a first embodiment according to the present invention.
Figure 12:
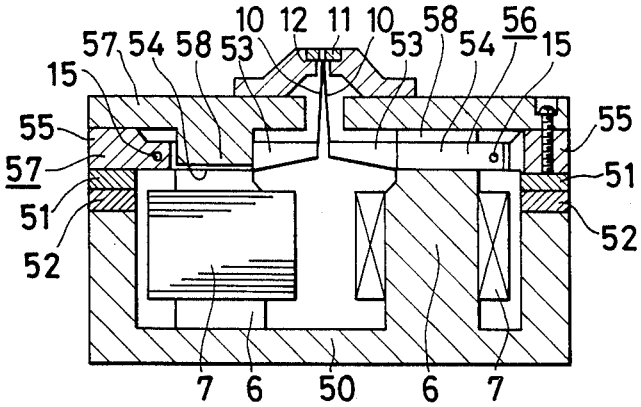
FIG.12 (PRIOR ART)
FIG. 12 is a sectional view of a conventional dot print head.
Figure 13:
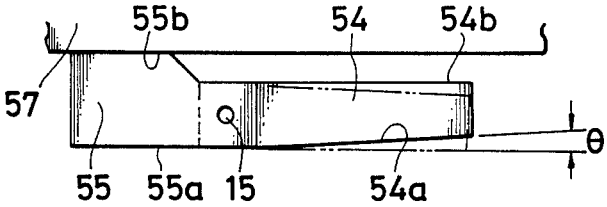
FIG.13 (PRIOR ART)
FIG. 13 is a fragmentary enlarged side elevation of an armature connected to a holder in the dot print head of FIG. 12.
Figure 14:
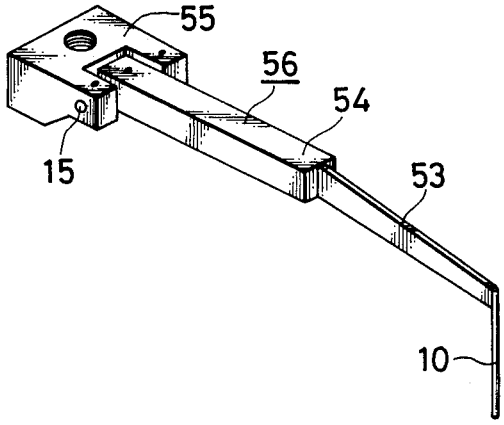
FIG.14 (PRIOR ART)
FIG. 14 is a perspective view of an armature assembly comprising an armature, a holder and a torsion bar incorporated into the dot print head of FIG. 12.

A dot print head in a first embodiment according to the present invention will be described with reference to FIGS. 1 to 6, in which parts like or corresponding to those previously described with reference to FIGS. 12 to 14 are denoted by the same reference numerals. As shown in FIG. 1, a second yoke 2 is joined to the open end of a first yoke 1 having a U-shaped cross section. A permanent magnet 3 is extended on the inner bottom surface of the first yoke 1. A plurality of cores 6 each having a foot 4 fixed to the permanent magnet 3, and a standing body 5 extending from the foot 4 is mounted respectively with solenoids 7. Armatures 8 respectively having thin arms 9 extending from the free ends thereof are disposed respectively opposite the cores 6. Styluses 10 are fixed respectively to the extremities of the arms 9. A stylus guide 11 for slidably guiding the styluses 10 is held on a nose 12 fixed to the second yoke 2. The stylus guide 11 and nose 12 serving as the sole guide means for the stylus 10. Projections 13 for receiving the armatures 8 therebetween, and supporting parts 14 for supporting the armatures 8 are formed integrally with the second yoke 2 in the inner surface of the same. The armatures 8 are connected to the supporting parts 14 with torsion bars 15, respectively.

Figure 2:
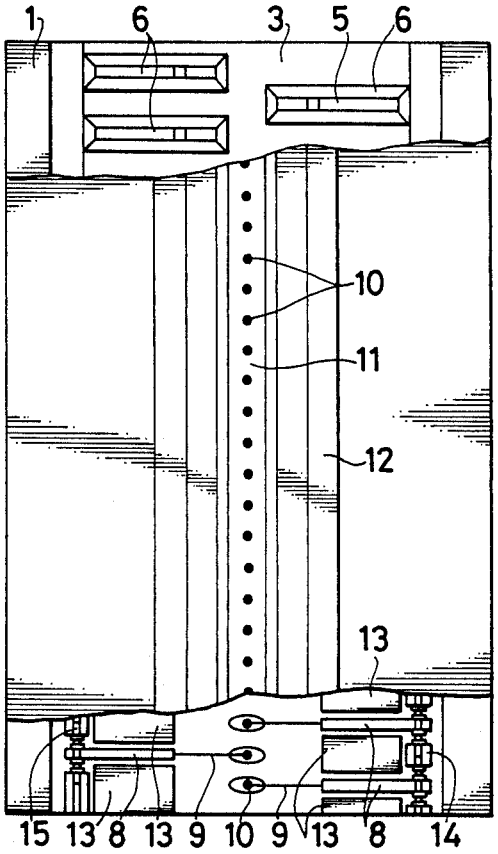
FIG. 2 is a partially cutaway plan view of the print dot head of FIG. 1.

Referring to FIG. 2, the upper portion, as viewed in FIG. 2, of the second yoke is partially broken and the solenoids 7 are omitted to show the arrangement of the cores 6, and the lower portion, as viewed in FIG. 2, of the second yoke 2 is partially broken to show the arrangement of the armatures 8, the projections 13 and the supporting parts 14. As is obvious from FIG. 2, electromagnets each consisting of the core 6, the solenoid 7 and the armature 8 are arranged zigzag in two straight rows. The electromagnets may be arranged in a circular arrangement.

Figure 3:
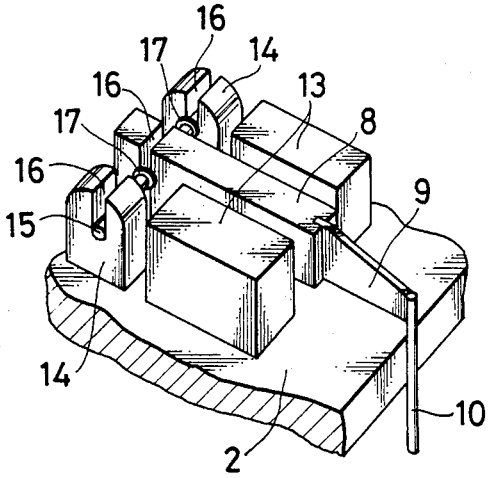
FIG. 3 is an enlarged fragmentary perspective view of an armature unit incorporated into the dot print head of FIG. 1, showing a construction for connecting an armature and supporting parts.
Figure 4:
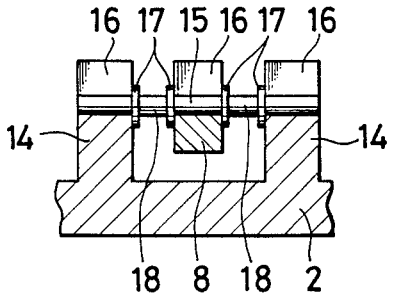
FIG. 4 is a fragmentary sectional view of the armature unit of FIG. 3.

Referring to FIGS. 3 and 4, a torsion bar 15 formed of an elastic metal, such as a low-carbon nickel-rich alloy steel, is fitted in U-shaped grooves 16 formed in the armature 8 and the supporting parts 14. The torsion bar 15 has integrally elastic portions 18 extending on the opposite sides of the armature 8, and flanges 17 formed at the opposite ends of the elastic portions 18 so as to be contiguous with the side walls of the supporting parts 14 and the armature 8. A brazing filler metal, not shown, filled in the grooves 16 is melted to braze the torsion bar 15 to the armature 8 and the supporting parts 14. In brazing the torsion bar 15 to the armature 8 and the supporting parts 14, the armature 8 is separated from the end surface (attracting surface) of the standing body 5 of the core 6. When the dot print head is assembled, the armature 8 is attracted to the end surface of the core 6 by the magnetism of the permanent magnet 3 elastically twisting the torsion bar 15, in which the torsional moment generated by the permanent magnet 3 is greater than that generated by the torsion bar 15.

Figure 5:
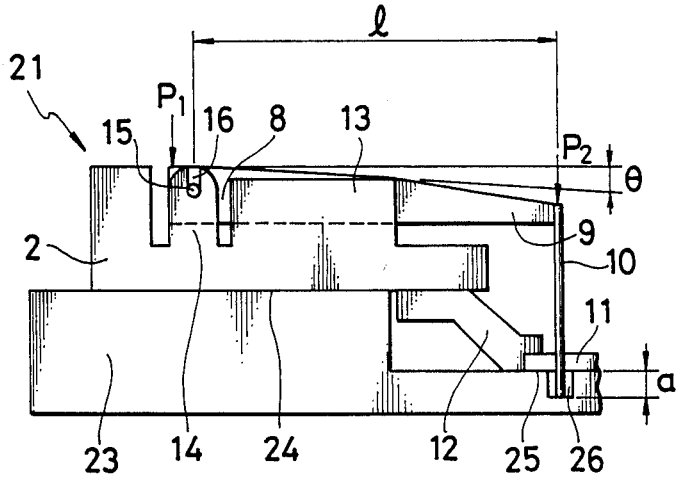
FIG. 5 is an enlarged fragmentary view showing the connection of an armature to the supporting parts of a second yoke in the dot print head of FIG. 1.
Figure 6:
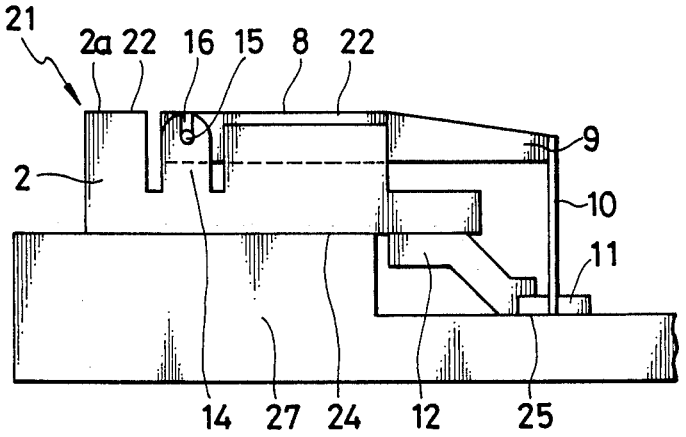
FIG. 6 is an enlarged fragmentary side elevation of assistance in explaining the manner of polishing the respective surfaces of the second yoke and the armatures on the side of the cores in forming the dot print head of FIG. 1.

In assembling the dot print head, the permanent magnet 3 is attached to the first yoke 1, the plurality of cores 6 are attached to the permanent magnet 3, and then the solenoids 7 are mounted respectively on the cores 6. The open end of the first yoke 1 and the end surfaces of the standing bodies 5 of the cores 6 are ground and polished flush to form polished surfaces 20. The second yoke 2 fixedly provided with the nose 12 is placed inside up, and then the opposite ends of the torsion bar 15 fitted in the groove 16 of the armature 8 at the middle portion thereof are fitted in the grooves 16 of the supporting parts 14. Then, as shown in FIG. 5, the first yoke 1 is placed on a jig 23. The jig 23 has a reference surface 24 for positioning the outer surface of the second yoke 2, a reference surface 25 for positioning the outer surface of the stylus guide 11, and a plurality of holes 26 formed in the reference surface 25, for positioning the styluses 10 so that the free ends of the styluses 10 project from the reference surface 25 into the holes 26 by a predetermined length a of projection. A small external force P1 is applied to the base ends of the armatures 8 and a small external force P2 is applied to the fixed ends of the styluses 10 to project the free ends of the styluses 10 stably into the corresponding holes 26. In this state, the brazing filler metal placed in the grooves 16 is melted to braze the torsion bars 15 to the armatures 15 and the supporting parts 14 of the second yoke 2. Thus, an armature unit 21 is completed. In this state, the surface to be placed opposite the core 6 of each armature 8 is inclined at an angle $\theta$ to a plane corresponding to a plane including the end surfaces of the cores 6. Then, as shown in FIG. 6, the armature unit 21 is placed on a jig 27. The jig 27 is similar to the jig 23, except that no hole 26 is provided. Accordingly, when the armature unit 21 is placed on the jig 27, the styluses 10 are pushed up and thereby the tips of the styluses 10 are aligned with the outer surface of the stylus guide 11 and armatures 8 are turned twisting the elastic portions 18 of the torsion bars 15. In this state, the end surface 2*a* of the second yoke 2 and the surfaces of the armatures 8 on the side of the cores 6 are ground and polished to form flush polished surfaces 22 on the second yoke 2 and the armatures 8. Then, the magnet unit 19 and the armature unit 21 are joined together with the respective polished surfaces 20 and 22 in contact with each other to complete the dot print head. When the dot print head is thus assembled, the armatures 8 are in close contact respectively with the end surfaces of the cores 6.

When one specified solenoid 7 among the solenoids 7 is energized, the magnetism acting on the corresponding armature 8 is cancelled by the magnetism of the solenoid 7, so that the armature 8 is separated by the restorative force of the elastic portions 18 of the torsion bar 15 to advance the stylus 10 toward the platen for printing. When the solenoid 7 is de-energized, the armature 8 is attracted again to the end surface of the core 6 by the magnetism of the permanent magnet 3 elastically twisting the torsion bar 15.

Since the torsion bar 15 can easily be fitted in the grooves 16 opening toward the core 6 in connecting the supporting parts 14 of the second yoke 2 and the armature 8, and the supporting parts 14 are formed integrally with the second yoke 2, the number of component parts is reduced and the positional difference between the armatures 8 is reduced. Furthermore, since the polished surfaces 20 are formed flush in the end surface of the first yoke 1 and the end surfaces of the cores 6, and the armatures 8 are located with respect to the position of the tips of the styluses 10, which affects print quality directly, in brazing the torsion bars 15 to the armatures 8 and the supporting parts 14 and in polishing the end surface 2*a* of the second yoke 2 and the surfaces of the armatures 8 on the side of the cores 6, the position of the armatures 8 relative to the cores 6, the position of the tips of the styluses 10, and the stroke of the styluses 10 are determined without variation between the armatures. Accordingly, the dot print head is capable of operating at a high printing speed requiring a comparatively small driving power and capable of forming clear prints.

Since the cores 6 are fixed to the permanent magnet 3, a comparatively short magnetic path is formed through each armature 8. The zigzag arrangement of the cores 6 in two rows at predetermined regular intervals prevents the leakage of magnetic flux and magnetic interference between the adjacent cores 6. Furthermore, since the area of contact of the foot 4 of the core 6 with the permanent magnet 3 is greater than the sectional area of the standing body 5 of the same, the magnetism of the permanent magnet 3 is used effectively and the magnetic flux density in the standing body 5 of the core is increased to enhance the attraction acting on the armature 8. Still further, since the styluses 10 are arranged in a single row, dot pitch on a vertical line perpendicular to the axis of the platen can be adjusted by mounting the assembly of the yokes 1 and 2 on a carriage which reciprocates along the platen at an optional inclination so that the styluses 10 are aligned respectively with straight lines inclined slightly to a vertical line perpendicular to the axis of the platen. Since the leakage of magnetic flux and magetic interference between the adjacent cores 6 can be prevented as mentioned above, each solenoid 7 can be energized selectively at an optional moment, and thereby dots can be printed at an optional dot pitch along the axis of the platen.

Furthermore, use of the grooves 16 for receiving the torsion bars for containing the brazing filler metal reduces machining steps by half. The flanges 17 of the torsion bar 15 facilitates the positioning of the torsion bar with respect to the axial direction, prevents the flow of the molten brazing filler metal over the elastic portions 18, and increases the area of contact of the brazing filler metal with the supporting parts 14 and the torsion bar 15 to reinforce the brazed portions. The torsion bar 15 may previously be provided fixedly on the armature 8 and the grooves 6 may be formed only in the supporting parts 14 or, on the contrary, the torsion bar 15 may previously be provided fixedly on the supporting parts 14 and the groove 16 may be formed only in the armature 8.

Thus, in the first embodiment, the torsion bars can easily be fitted in the grooves opening toward the cores and are joined to the supporting parts of the second yoke and the armatures, forming the supporting parts integrally with the second yoke reduces the number of the component parts and reduces the positional difference between the armatures. Furthermore, since the open end of the first yoke and the end surfaces of the cores are polished so as to be flush and since the armatures are positioned with respect to the position of the tips of the styluses, which affects print quality directly, in brazing the torsion bars to the armatures and the supporting parts and in polishing the inner surface of the second yoke and the surfaces of the armatures on the side of the cores, the position of the armatures relative to the corresponding cores, the position of the tips of the styluses and the stroke of the styluses are determined without variation between the armatures. Accordingly, the dot print head in the first embodiment according to the present invention is capable of operating at a high printing speed requiring a comparatively small driving power and capable of printing in high print quality.

Figure 7:
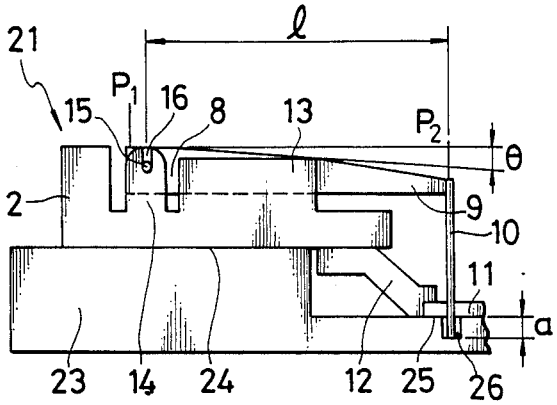
FIG. 7 is a fragmentary side elevation of a dot print head in a second embodiment according to the present invention, showing the connection of an armature to the supporting parts of a second yoke.
Figure 8:
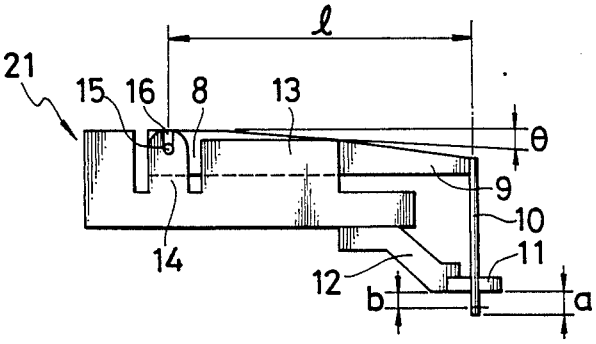
FIG. 8 is a fragmentary side elevation of assistance in explaining a process of cutting styluses through a wire-cut electrical discharge cutting process.
Figure 9:
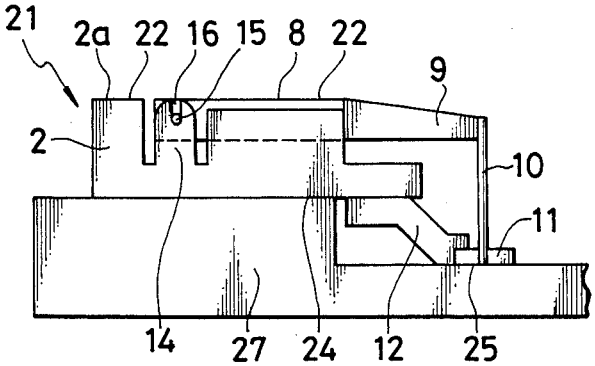
FIG. 9 is an enlarged fragmentary side elevation of assistance in explaining the manner of polishing the respective surfaces of the second yoke and the armatures on the side of the cores in forming the dot print head of FIG. 7.

Second Embodiment (FIGS. 7 to 9)

A dot print head in a second embodiment according to the present invention will be described hereinafter with reference to FIGS. 7 to 9, in which parts like or corresponding to those of the first embodiment are denoted by the same reference numerals and the description thereof will be omitted.

A second yoke 2 is placed on a jig 23 as shown in FIG. 7. The jig 23 has a reference surface 24 for positioning the outer surface of a second yoke 2, a reference surface 25 for positioning the outer surface of a stylus guide 11, and a plurality of holes 26 formed in the reference surface 25, for positioning styluses 10 so that the free ends of the styluses 10 project from the reference surface 25 into the holes 26 by a predetermined length a of projection. A small external force P1 is applied to the base ends of armatures 8 and a small external for P2 is applied to the fixed ends of the styluses 10 to project the free ends of the styluses 10 stably into the corresponding holes 26. In this state, a brazing filler metal placed in grooves 16 formed in the supporting parts 14 of the second yoke 2 and the armatures 8 is melted to braze torsion bars 15 to the armatures 15 and the supporting parts 14 of the second yoke 2. Thus, an armature unit 21 is completed. In this state, the surface of each armature 8 to be placed opposite a core 6 is inclined at an angle $\theta$ to a plane corresponding to a plane including the end surfaces of the cores 6. The length a of projection of the free end of each stylus 10 projecting from a stylus guide 11 is slightly greater than a length of projection by which the free end of each stylus 10 projects from the stylus guide 11 in actual printing operation. The respective lengths of projection of the free ends of the styluses 10 are within a predetermined allowable range.

Then, as shown in FIG. 7, the second yoke 2 is removed from the jig 23, the second yoke is held fixedly, the external forces are removed from the armatures 8 and the styluses 10 to relieve the styluses 10 from stress, and then portions of the free ends of the styluses 10 are cut off by a wire-cut electrical discharge cutting process to adjust the length of projection of each stylus 10 to a length b of projection, which is smaller than the length a of projection. During the wire-cut electrical discharge cutting process, no stress is exerted on the styluses 10 and no cutting force acts on the styluses 10, and hence the length of projection of the styluses 10 is adjusted accurately to the length b of projection. In the wire-cut electrical discharge cutting process, the wire serves as one electrode and the stylus 10 serves as the other electrode, and hence a voltage must be applied across the wire and the stylus 10. Since the styluses 10 are connected electrically through the arms 9 and the armatures 8 to the second yoke 2 and no insulating member is provided between the styluses 10 and the second yoke 2, a voltage is applied simply across the second yoke 2 and the wire.

Then, the armature unit 21 is placed on a jig 27. The jig 27 is similar to the jig 23, except that no hole 26 is formed in the jig 27. Accordingly, when the armature unit 21 is placed on the jig 27, the styluses 10 are pushed up and thereby the tips of the styluses 10 are aligned with the outer surface of the stylus guide 11 and armatures 8 are turned twisting the elastic portions 18 of the torsion bars 15. In this state, the end surface 2*a* of the second yoke 2 and the surfaces of the armatures 8 on the side of the cores 6 are ground and polished to form flush polished surfaces 22 on the second yoke 2 and the armatures 8. Then, the magnet unit 19 and the armature unit 21 are joined together with the respective polished surfaces 20 and 22 in contact with each other to complete the dot print head. When the dot print head is thus assembled, the armatures 8 are in close contact respectively with the end surfaces of the cores 6.

In the dot print head thus constructed, since the flush polished surfaces 20 are formed in the end surface of the first core 1 and the end surfaces of the cores 6, and the armatures 8 are located with respect to the tips of the styluses 10 in brazing the torsion bars 15 to the armatures 8 and the supporting parts 14, the respective lengths of projection of the styluses 10 are adjusted to lengths within a predetermined range about the length a of projection. The length of the styluses 10 is adjusted accurately in a free state to the length b of projection by a wire-cut electrical discharge cutting process, and the end surface of the second yoke 2 and the surfaces of the armatures 8 on the side of the cores are polished with respect to the position of the tips of the styluses 10, which affects print quality directly. Thus, the position of the armatures 8 relative to the corresponding cores 6, the position of the tips of the styluses 10 and the stroke of the styluses 10 are determined without variation between the armatures 8. Accordingly, the dot print head is capable of operating at a high printing speed requiring reduced driving power and capable of forming clear prints.

Thus, in the second embodiment, the end surface of the first core and the end surfaces of the cores are polished in flush surfaces, the armatures are located with respect to the position of the tips of the styluses projecting by a predetermined length of projection, in brazing the torsion bars to the armatures and the supporting parts, to adjust the respective lengths of projection of the styluses to values within an allowable range. Since the armatures are located with reference to the position of the tips of the styluses, which affects print quality directly, in polishing the end surface of the second yoke and the surfaces of the armatures on the side of the cores, the position of each armatures relative to the corresponding core, the position of the tips of the styluses and the stroke of the styluses are determined without variation between the armatures. Accordingly, the dot print head is capable of operating at a high printing speed requiring reduced driving power and capable of printing in high print quality.

Figure 10:
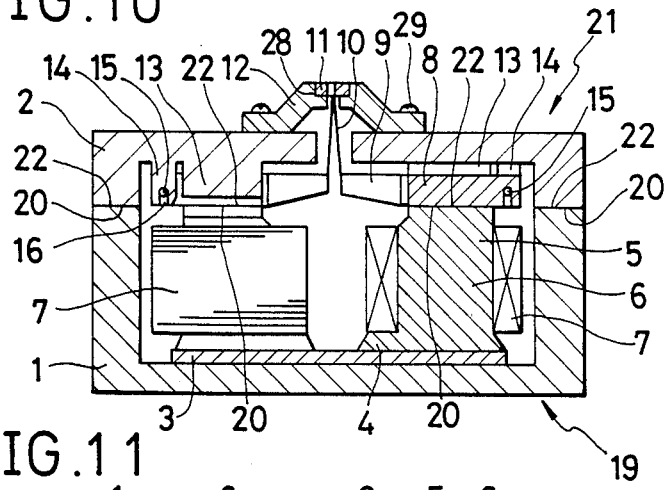
FIG. 10 is a sectional view of a dot print head in a third embodiment according to the present invention.
Figure 11:
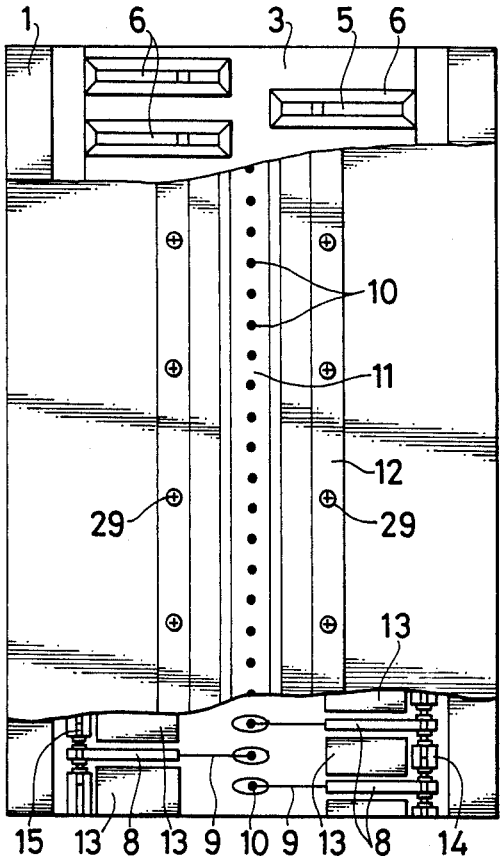
FIG. 11 is a partially cutaway plan view of the dot print head of FIG. 10.

Third Embodiment (FIGS. 10 and 11)

A dot print head in a third embodiment according to the present invention will be described hereinafter with reference to FIGS. 10 and 11, in which parts like or corresponding to those previously described with reference to FIGS. 12 to 14 and those of the foregoing embodiments are denoted by the same reference numerals.

A stylus guide 11 employed in the third embodiment is formed of a tool steel capable of being provided with high abrasion resistance by a heat treatment and is attached adhesively to a nose 12 with a heat-resistant inorganic adhesive 28. The nose 12 is formed of a sintered iron alloy. The nose 12 is fastened to a second yoke 2 with screws 29 of an iron alloy. The nose 12 may be attached adhesively to the second yoke 2 with a heat-resistant adhesive containing a ceramic material, such as alumina or zirconia, as the principal component. It is also possible to form the nose 12 and the second yoke 2 in an integral member through a lost wax process. Projections 13 for receiving armatures 8 therebetween, and supporting parts 14 are formed integrally with the second yoke 2 in the inner surface of the same. The armatures 8 and the supporting parts 14 are connected by torsion bars 15, respectively. The torsion bars 15 are formed of a maraging steel, namely, a low-carbon nickel-rich alloy steel.

The second yoke 2, the armatures 8, the torsion bars 15, the nose 12, the stylus guide 11 and the screws 29 constructing an armature unit 21 are formed respectively of iron alloys which are approximately the same in coefficient of thermal expansion.

The armature unit 21 thus constructed is subjected to heat treatment after brazing the torsion bars 15 to the armatures 8 and the supporting parts 14. Although the armature unit 21 is heated at a temperature of 500° C. for three hours for heat treatment, the dimensions of the armature unit 21 will not vary and the junctions of the component parts will not be broken, because the coefficients of thermal expansion of the materials forming the second yoke 2, the armatures 8, the torsion bars 15, the nose 12, the stylus guide 11 and the screws 29 are approximately the same. Although the stylus guide 11 is attached adhesively to the nose 12 with the heat-resistant inorganic adhesive 28, the stylus guide 11 will not fall off from the nose 12 when heated, because the heat-resistant inorganic adhesive 28 is resistant to a high temperature of 1000° C. or above. The adhesion is dependent on the shape of the stylus guide 11 as well as the coefficient of thermal expansion. When the size of the stylus guide 11 increases, the absolute thermal expansion of the stylus guide 11 increases accordingly to reduce the bonding effect of the adhesive. In the third embodiment, the stylus guide 11 is 70 mm in length and approximately 2 mm in thickness. The thermal expansion of the stylus guide 11 in the heat treatment was negligibly small and sufficient adhesion was secured. Since the armature unit 21 incorporating the plurality of armatures 8 is subjected to the heat treatment, the assembling process is simplified.

Most parts of the dot print head are formed of a soft magnetic material, such as silicon steel, and hence pure iron is a material suitable for forming the stylus guide 11 and the nose 12. Since the stylus guide 11 is small in size and the absolute thermal expansion of the same is comparatively small, the stylus guide 1 may be formed of a ceramic material, such as alumina or zirconia, if pure iron is much the same as ceramic materials in coefficient of thermal expansion.

Thus, in the third embodiment, the armature unit is subjected to heat treatment for the heat treatment of the torsion bars after brazing the torsion bars to the supporting parts of the second yoke, and the armatures, which simplifies the assembly process. Furthermore, since the component parts of the armature unit are formed of materials which are much the same in coefficient of thermal expansion, the dimensions of the armature unit are not subject to variation attributable to heat treatment.

What is claimed is:

1. A release-type dot print head comprising a magnet unit and an armature unit joined to the magnet unit, said magnet unit comprising:

a first yoke having an open end, a permanent magnet extended on the inner bottom surface of the first yoke, and a plurality of cores mounted respectively with solenoids and arranged on the permanent magnet; and said armature unit comprising:

a second yoke having an end surface and supporting parts formed in the inner surface thereof, a plurality of armatures each fixedly holding a stylus at the free end thereof and arranged between the adjacent supporting parts of the second yoke so as to be positioned respectively opposite the cores of the magnet unit, a stylus guide for guiding the styluses fixedly held on the armatures, attached to the second yoke, torsion bars fitted in open grooves opening toward the cores, formed at least in either the armatures or the supporting parts of the second yoke and in receiving parts including grooves similar to those formed in either the armatures or the supporting parts in either the supporting parts or the armatures, and brazed respectively to the armatures and the supporting parts of the second yoke with the armatures in a state in which the free ends of styluses are projected from the outer surface of the stylus guide by a predetermined length;

wherein the surface of the open end of the first yoke and the end surfaces of the cores are finished in flush polished surfaces, and the end surface of the second yoke and the surfaces of the armatures on the side of the cores are finished in flush polished surfaces with the armatures in a state in which the tips of the styluses are in alignment with the outer surface of the stylus guide, so as to be in close contact with the flush polished surfaces of the first yoke and the cores when the armature unit is joined to the magnet unit.

2. A method of manufacturing a release-type dot print head, comprising the steps of:

forming a magnet unit by assembling a first yoke having an open end, a plurality of cores mounted respectively with solenoids, and a permanent magnet;

forming a plurality of armatures each having a surface to be positioned opposite the corresponding cores of the magnet unit, and a stylus fixed to the free end thereof;

forming a second yoke provided with a stylus guide for guiding the styluses of the armatures, and having an end surface to be joined to the surface of the open end of the first yoke, and a plurality of supporting parts formed integrally therewith so as to receive the armatures therebetween;

forming grooves opening toward the cores at least in either the armatures or the supporting parts to receive torsion bars therein;

forming receiving parts for receiving the torsion bars, including grooves similar to those formed in either the armatures or the supporting parts, in either the supporting parts or the armature;

forming an armature unit by brazing the torsion bars fitted in the grooves and the receiving parts to the armatures and the supporting parts in a state in which the free ends of the styluses are projected from the outer surface of the stylus guide by a predetermined length;

polishing the surface of the open end of the first yoke and the end surfaces of the cores in flush polished surfaces;

polishing the end surface of the second yoke and the surfaces of the armature on the side of the cores in flush surfaces in a state in which the tips of the styluses are aligned with the outer surface of the stylus guide; and joining the magnet unit and the armature unit together with the corresponding polished surfaces in close contact with each other.

3. A release-type dot print head comprising a magnet unit and an armature unit joined to the magnet unit, said magnet unit comprising:

a first yoke having an open end, a permanent magnet extended on the inner bottom surface of the first yoke, and a plurality of cores mounted respectively with solenoids and arranged on the permanent magnet; and said aramture unit comprising:

a second yoke having an end surface and supporting parts formed in the inner surface thereof, a plurality of armatures each fixedly holding a stylus at the free end thereof and arranged between the adjacent supporting parts of the second yoke so as to be positioned respectively opposite the cores of the magnet unit, a stylus guide for guiding the styluses fixedly held on the armatures, attached to the second yoke, torsion bars fitted in open grooves opening toward the cores, formed at least in either the armatures or the supporting parts of the second yoke and in receiving parts including grooves similar to those formed in either the armatures or the supporting parts in either the supporting parts or the armature, and brazed respectively to the armatures and the supporting parts of the second yoke with the armatures held in a state in which the free ends of the styluses are projected from the outer surface of the stylus guide by a predetermined length;

wherein portions of the free ends of the styluses projecting in a free state from the outer surface of the stylus guide are cut off by a wire-cut electrical discharge cutting process to adjust the length of projection of the styluses in a free state from the outer surface of the stylus guide to a predetermined length, the surface of the open end of the first yoke and the end surfaces of the cores are finished in flush polished surfaces, the end surface of the second yoke and the surfaces of the armatures on the side of the cores are finished in flush polished surfaces with the armatures in a state in which the tips of the styluses are in alignment with the outer surface of the stylus guide, and the magnet unit and the armature unit are joined together with the corresponding polished surfaces in contact with each other.

4. A method of manufacturing a release-type dot print head, comprising the steps of:

forming a magnet unit by assembling a first yoke having an open end, a plurality of cores mounted respectively with solenoids, and a permanent magnet;

forming a plurality of armatures each having a surface to be positioned opposite the corresponding core of the magnet unit, and a stylus fixed to the free end thereof;

forming a second yoke provided with a stylus guide for guiding the styluses of the armatures, and having an end surface to be joined to the surface of the open end of the first yoke, and a plurality of supporting parts formed integrally therewith so as to receive the armatures therebetween;

forming grooves opening toward the cores at least in either the armature or the supporting parts to receive torsion bars therein;

forming receiving parts for receiving the torsion bars, including grooves similar to those formed in either the armatures or the supporting parts in either the supporting parts or the armatures;

forming an armature unit by brazing the torsion bars respectively to the armatures and the supporting parts with the armature fixed in a state in which the free ends of the styluses are projected from the outer surface of the stylus guide by a predetermined length;

adjusting the length of the free ends of the styluses projecting from the outer surface of the stylus guide to a predetermined length by cutting off portions of the free ends of the styluses by a wire-cut electrical discharge cutting process with the styluses in a free state;

finishing the surface of the open end of the first yoke and the end surfaces of the cores in flush polished surfaces;

finishing the end surface of the second yoke and the surfaces of the armatures on the side of the cores in flush polished surfaces with the armatures in a state in which tips of the styluses are in alignment with the outer surface of the stylus guide; and joining the magnet unit and the armature units together with the corresponding polished surfaces in close contact with each other.

* * * * *